United States Patent [19]

Schukey

[11] 3,978,680

[45] Sept. 7, 1976

[54] HEAT ENGINE

[76] Inventor: Jürgen Schukey, Borgfelde 16, 2000 Hamburg-Schenefeld, Germany

[22] Filed: Dec. 5, 1974

[21] Appl. No.: 530,010

[30] Foreign Application Priority Data

Dec. 6, 1973 Germany ..... 2360865

[52] U.S. Cl. ..... 62/6; 62/402; 60/519

[51] Int. Cl.[2] ..... F25B 9/02; F25D 9/00; F01B 29/10; F02G 1/04

[58] Field of Search ..... 60/516, 517, 524, 525, 60/526; 62/6, 402

[56] References Cited

UNITED STATES PATENTS

| | | | |
|---|---|---|---|
| 678,570 | 7/1901 | Jones | 418/194 |
| 2,358,815 | 9/1944 | Lysholm | 417/53 |
| 2,480,818 | 8/1949 | Whitfield | 418/201 |
| 2,582,297 | 1/1952 | Thatcher | 62/402 |
| 3,297,006 | 1/1967 | Marshall | 62/402 |
| 3,483,694 | 12/1969 | Huber | 60/519 |
| 3,791,136 | 2/1974 | Witteveen | 60/526 |
| 3,812,682 | 5/1974 | Johnson | 62/6 |
| 3,815,362 | 6/1974 | Kolbinger | 60/525 |
| 3,861,146 | 1/1975 | Lynch | 60/524 |

FOREIGN PATENTS OR APPLICATIONS

| | | | |
|---|---|---|---|
| 198,588 | 9/1965 | Sweden | 62/402 |

*Primary Examiner*—Lloyd L. King
*Attorney, Agent, or Firm*—Walter Becker

[57] ABSTRACT

A heat engine in which a working gas is in a continuous thermodynamic cycle passed through compression and expansion stages in respective compression and expansion chambers which have associated therewith heat exchanger means transferring heat developed in the working gas in the compression chambers during the compression stage to the working gas in the expansion chambers during the expansion stage of the working gas.

6 Claims, 10 Drawing Figures

HEAT ENGINE

This invention relates to heat engines and more particularly to a heat engine in which a working gas passes through the phases of a thermodynamic cycle in a working chamber.

For an assessment of any heat engine its thermal efficiency is of material importance. The greatest possible thermal efficiency would be attained if the working gas in the engine passed through the phases of a Carnot or an Ericsson cycle. In the design of an engine in which a working gas is to pass through changes of state, it is, therefore, the aim to take steps which will improve these changes of state in a direction approaching one of the above referred to ideal cycles.

The Ackeret-Keller cycle approximates the ideal Ericsson cycle in continuous flow machines. However, comparable results have not been achieved in heat engines of conventional construction.

For the design of heat engines, the Ericsson cycle has considerable merits over the Carnot cycle because of its higher indicated pressure. In an Ericsson cycle the working gas passes through the following phases:

1. Isothermal compression,
2. Isobaric expansion,
3. Isothermal expansion,
4. Isobaric compression.

Whereas heat which must be removed is generated during compression of the working gas, the gas cools in expansion and this heat loss must be made good by a supply of heat. In conventional primary engines, energy loss is experienced both in the supply and in the removal of heat.

It is therefore an object of the present invention so to improve a heat engine of the above specified kind that it will more closely approach the thermal efficiency of an ideal Ericsson cycle by avoiding energy loss.

These and other objects and advantages of the invention will appear more clearly from the following specification, in connection with the accompanying drawings, in which.

Figure 1:
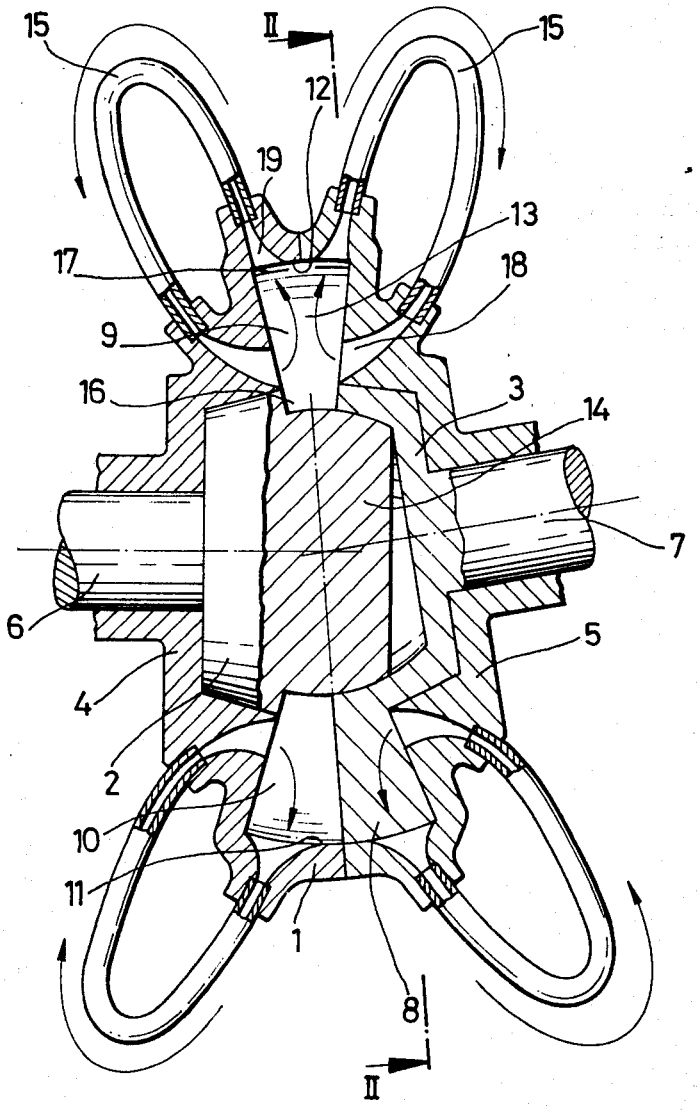
FIG. 1 is a longitudinal section of a hot gas engine according to the invention.
Figure 2:
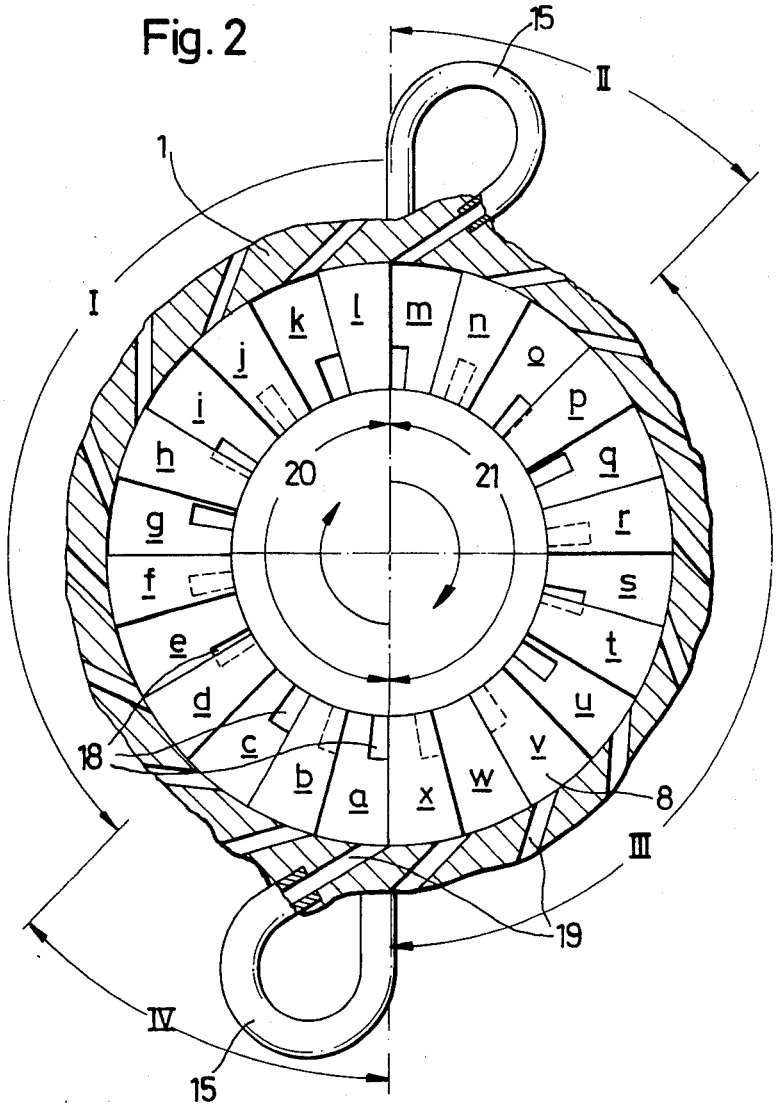
FIG. 2 is a cross section of the hot gas engine taken on the line II—II in FIG. 1.
Figure 5:
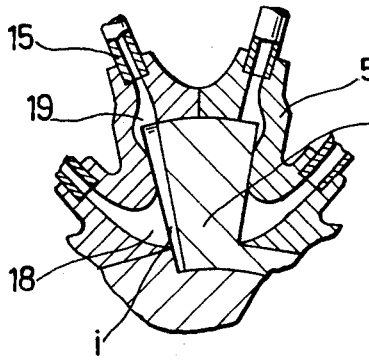
FIG. 5 is a longitudinal section of the chamber *i* in FIG. 2.
Figure 4:
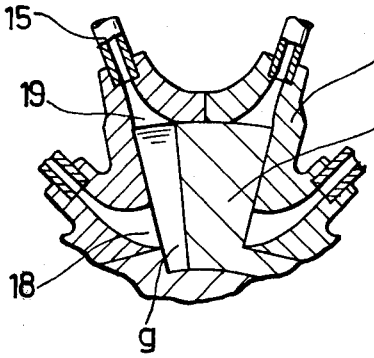
FIG. 4 is a longitudinal section of the chamber *g* in FIG. 2.
Figure 3:
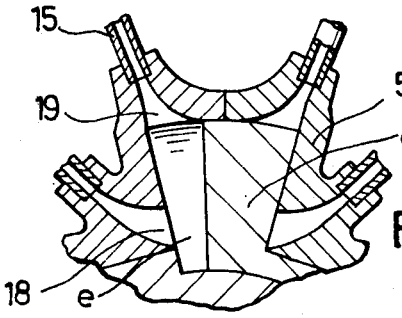
FIG. 3 is a longitudinal section of chamber *e* in FIG. 2.
Figure 6:
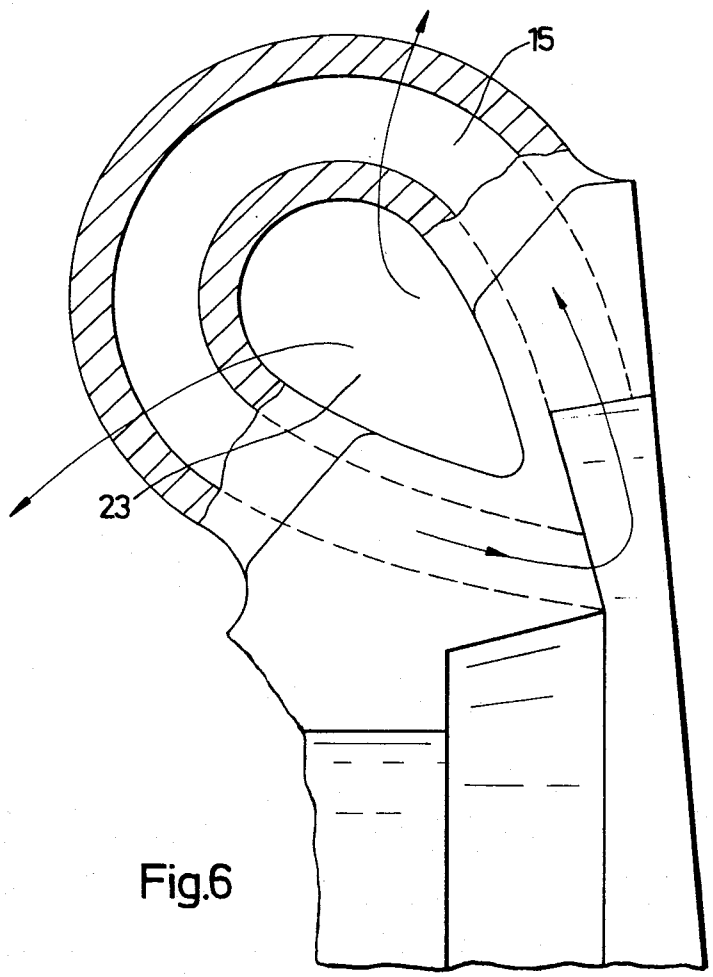
FIG. 6 is a longitudinal section of the pipe loops constituting the heat exchanger.
Figure 7:
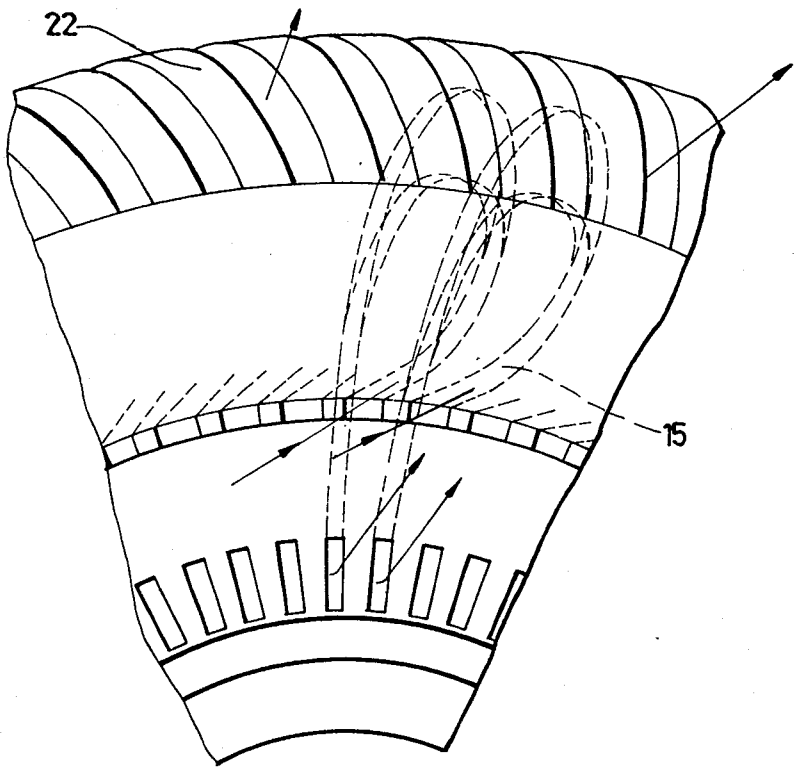
FIG. 7 is a partial view of the pipe loop arrangement.
Figure 10:
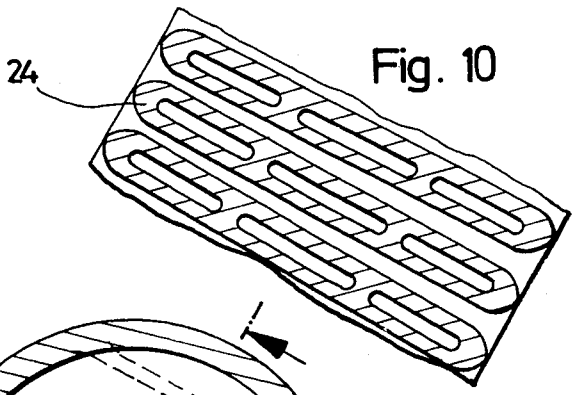
FIG. 10 is a longitudinal section of a heat transfer element.
Figure 8:
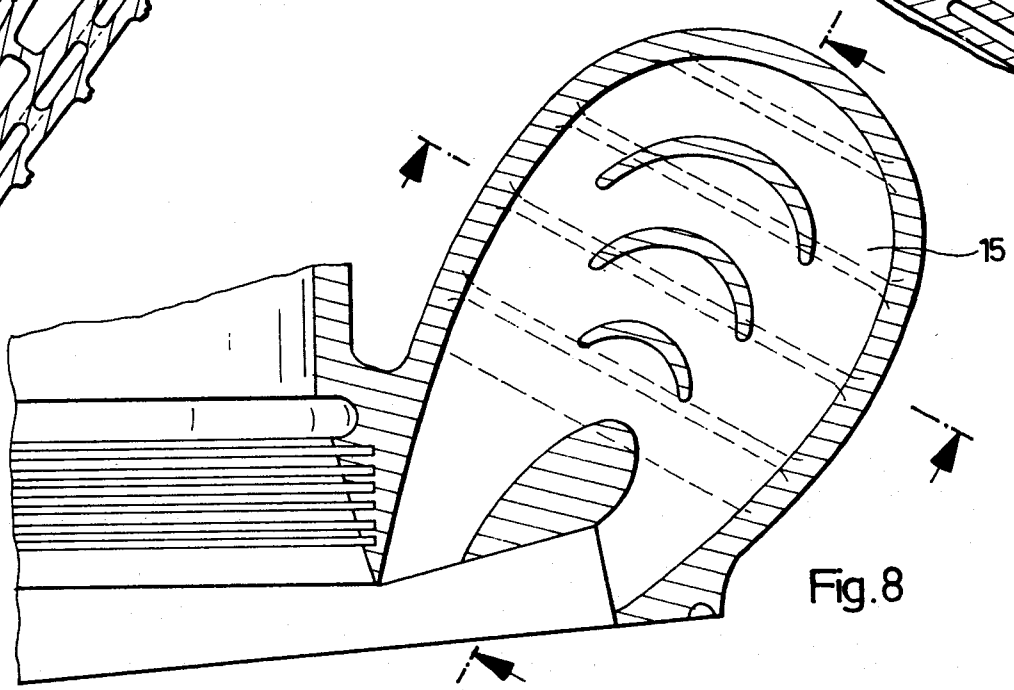
FIG. 8 is a longitudinal section of a pipe loop having an enlarged heat transfer surface.
Figure 9:
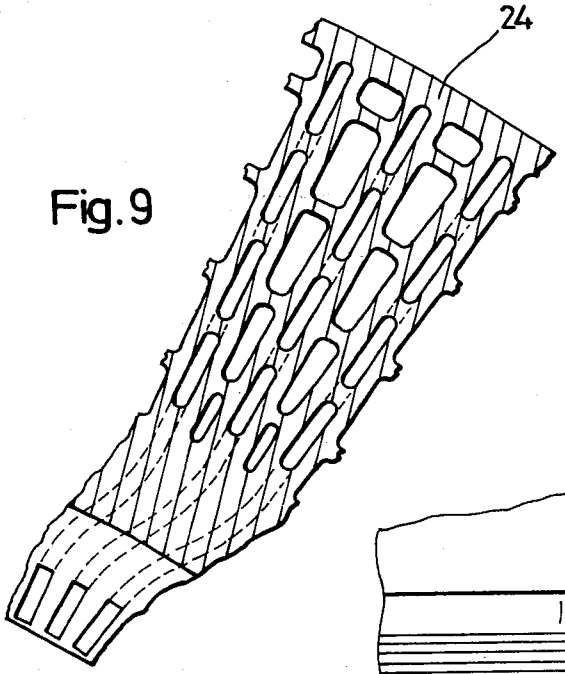
FIG. 9 is a cross section of a heat transfer element.

The heat engine according to the invention is characterized primarily in that a heat exchanger is provided for transferring a part of the heat of compression to the working gas during expansion.

This proposal enables the heat requiring abstraction during compression to be partly retained in the cycle. Energy losses by an unnecessarily large abstraction of heat from compression and the supply of some heat for expansion are thus saved.

According to a preferred embodiment of the invention the heat engine contains a working chamber which travels in a circular path and in which centrifugal forces generate a zone of reduced pressure in the inner portions nearer to the center of the circular motion and a zone of increased pressure in the outer portions.

This arrangment in the proposed heat engine creates zones of different pressures inside the working chamber, and the pressure differentials can be used for the generation of a gas flow through the heat exchanger.

Referring now to the drawings in detail, a primary engine illustrated therein in the form of a hot gas engine substantially comprises a housing 1 and two rotors 2 and 3. The casing 1 comprises two sections 4 and 5 in which the rotors 2 and 3 are journaled in an overhung or cantilever fashion on shafts 6, 7. The housing sections 4 and 5 are so fitted together that the extensions of the axes of the two shafts 6 and 7 intersect each other at an angle $\beta$ in the center of the housing 1.

In a manner resembling the meshing teeth of large crown wheels, the rotors 2 and 3 are around their peripheries provided with displacement bodies or pistons 8 in such a way that the pistons 8 of one rotor engage the gaps between the pistons 8 of the other rotor 3. In the course of each revolution of the two rotors 2 and 3, the pistons 8 slide in corresponding recesses 9 and 10 formed in the housing 1. These recesses 9 and 10 are in part defined by outer walls 11, 12 which enclose the recesses 9, 10 on their radially outer sides. The pistons 8 make sealing contact with these outer walls 11, 12.

The recesses 9, 10 define an annular working chamber 13 which extends around the housing 1 which has a larger capacity in the region of part 10 of the recess and becomes continuously smaller towards the shallowest part 9. This working chamber 13 is divided by the pistons 8 into a plurality of compression chambers *a-x*, of which there may be, for instance, twenty four. Each of these compression chambers *a-x* is bounded on three sides by the pistons 8 of which two adjacent pistons belong to one rotor 2 and the third piston which engages between the two former belongs to the other rotor 3. The remaining sides of the compression chambers *a-x* are formed by the housing 1 and by a spherical body 14 which functions as a rotor hub.

Distributed at equiangular intervals around the periphery of the casing 1 are pipes 15. These form loops connecting an inner portion 16 of the compression chambers *a-x* nearest the casing center to an outer portion 17 facing the inner portion in each compression chamber *a-x*. The pipe loops 15 communicate with the inner portion 16 through inlet ports 18 and with the outer portion 17 of the working chamber 13 through outlet ports 19.

When the rotors 2 and 3 revolve inside the housing 1, the pistons 8 progressively interengage as they move along the working chamber 13 from part 10 of the recess in the direction of part 9 of the recess and in this way they create a pressure center in each of the compression chambers *a-x*. This becomes progressively higher in the compression chambers *a-l* and progressivey lower in the compression chambers *m-x*. Each chamber *a-x* in the course of each revolution passes through a compression stage 20 and through an expansion stage 21. The working gas which is compressed in the several compression chambers *a-x* rotates together with the rotors 2 and 3 and the generated centrifugal forces accelerate the gas radially outwards. Consequently, higher pressure zones build up in the radially outer portions 17 of the several compression chambers *a-x* whereas the pressures in the radially inner portions 16 of the compression chambers *a-x* are relatively reduced. These pressure differentials are equalized through the pipe loops 15 in which a steady flow of gas will thus be maintained from the outer portions 17 in the direction towards the inner portions 16. Owing to this continuous passage of gas through the pipe loops, these accept the temperature of the working gas. Consequently, the heat in the working gas can be given off by the pipe loops 15 to the outside.

The heat thus removed during the compression stage 20 is now conveniently used to improve the thermal efficiency of the engine by being transferred to the working gas as it cools in the expansion stage. For this purpose the pipe loops 15 are associated in a heat exchanger 22 in which the heat supplying working gas flows through the pipe loops 15 whereas the heat accepting working gas flows through the ring-shaped inside space 23 embraced by the pipe loop 15.

Moreover, in order to improve the transfer of heat, the pipe loops 15 may be provided with inside structures 24 which extend their heat transferring surface, the working gas flowing through these structures, which resemble perforated strips, thus improving the transfer of heat into the walls of the pipe loops 15.

Preferably the pipe loops 15 adjoin the outlet ports 19 in the compression chambers *a-x* tangentially in the direction of flow of the working gas entrained by the pistons 2, 3. This facilitates the entry of the working gas into the pipe loops 15. For this reason the pipe loops 15 at first continue from the outlet ports 19 in the tangential direction before bending around the loop and back to the inlet ports 18. These enter the inside portion 16 of the compression chambers *a-x* through a straight terminal portion of pipe to create as little drag in the pipes at the re-entry into the working chamber 13 as possible.

In order to increase the pressure gradient, the outlet ports 19 may be arranged to lead angularly in the direction of rotor revolution. It is possible in this way to generate a lively flow of working gas through the pipe loops 15.

The pipe loops 15 may be of any length and they may be combined in any desired way to form a conventional heat exchanger in which the transfer of heat proceeds in cross flow or in counterflow. However, in order to shorten the distances, the working gas travels through the pipes and thereby to reduce the drag in the pipes, the housing 1 itself may be wholly or partly designed to form the heat exchanger.

The heat required for increasing the gas volume may be supplied to the working gas from an external source. For this purpose the working gas is heated from the outside as it flows through the pipe loops 15. This introduction of heat into the working gas from the outside has the advantage that burners operating under particularly efficient combustion conditions can be used. The production of toxic gases is thus substantially avoided, such as gases normally formed in conventional internal combustion engines in which combustion proceeds inside the compression chamber. However, internal combustion engines based on the above described principle can be constructed in which combustion takes place inside the working chamber 13. For this purpose a fuel injector may be provided at the end of the compression stage for the injection of fuel into the precompressed working gas.

The proposed machine can also with advantage be used for refrigeration or as a heat pump provided the transfer of heat in the heat exchanger 22 is suitably arranged by an appropriate disposition of the pipe loops 15.

It is, of course, to be understood that the present invention is, by no means, limited to the specific showing in the drawings, but also comprises any modifications within the scope of the appended claims.

What I claim is:

1. A heat engine which includes: housing means comprising a first section and a second section connected to each other, a first rotor and a second rotor respectively rotatably journaled in said first and second housing sections so that the extension of their axes intersect at an obtuse angle, the periphery of said rotors being provided with displacement bodies arranged in such a manner that the displacement bodies of one rotor in the manner of interengaging teeth extends between two displacement bodies of the other rotor, said displacement bodies together with said housing means forming compression chamber means adapted to receive a working gas and successively decreasing from a maximum volume to a minimum volume and also forming expansion chamber means successively increasing in volume from said minimum volume to said maximum volume for compressing and expanding a working gas so as to pass said working gas through the phases of a thermodynamic cycle, and heat exchanger means associated with said compression chamber means and operable to transfer heat developed in a working gas in said compression chambers during the compression stage to the working gas in the expansion chambers during the expansion stage of the working gas.

2. A heat engine according to claim 1, in which said heat exchanger means includes a plurality of pipes providing communication between differential pressure zones in said compression and expansion chamber means thus causing said working gas to circulate.

3. A heat engine according to claim 1, characterized in that said compression and expansion chamber means travel in a circular path whereby centrifugal forces generate a zone of reduced pressure in the inner portions nearer to the center of the circular motion and a zone of increased pressure in the outer portions.

4. A heat engine according to claim 2, in which said pipes connect the inner portions to the outer portions of the compression and expansion chamber means.

5. A heat engine according to claim 2, in which said pipes form loops defining a torus, the interior of said torus and the interior of said pipe loops forming heat exchanging surfaces.

6. A heat engine according to claim 5, which includes heat transferring structures provided inside said torus for increasing the heat transferring surface.

* * * * *